US009783395B2

(12) United States Patent
Albinger et al.

(10) Patent No.: US 9,783,395 B2
(45) Date of Patent: Oct. 10, 2017

(54) SYSTEM AND METHOD FOR CRANE COUNTERWEIGHT POSITIONING

(71) Applicant: Manitowoc Crane Companies, LLC, Manitowoc, WI (US)

(72) Inventors: Timothy James Albinger, Manitowoc, WI (US); John William Taylor, Manitowoc, WI (US); Brian Nicholas Nysse, Manitowoc, WI (US)

(73) Assignee: MANITOWOC CRANE COMPANIES, LLC, Manitowoc, WI (US)

( * ) Notice: Subject to any disclaimer, the term of this patent is extended or adjusted under 35 U.S.C. 154(b) by 0 days.

(21) Appl. No.: 15/082,284

(22) Filed: Mar. 28, 2016

(65) Prior Publication Data

US 2016/0289047 A1 Oct. 6, 2016

Related U.S. Application Data

(60) Provisional application No. 62/141,013, filed on Mar. 31, 2015.

(51) Int. Cl.

| | |
|---|---|
| ***B66C 13/18*** | (2006.01) |
| ***B66C 13/16*** | (2006.01) |
| ***B66C 13/46*** | (2006.01) |
| ***B66C 23/76*** | (2006.01) |

(52) U.S. Cl.

CPC ..... *B66C 13/18* (2013.01); *B66C 13/16* (2013.01); *B66C 13/46* (2013.01); *B66C 23/76* (2013.01)

(58) Field of Classification Search

CPC ..... B66C 13/16; B66C 13/18; B66C 23/76; B66C 13/46

See application file for complete search history.

(56) References Cited

U.S. PATENT DOCUMENTS 5,598,935 A * 2/1997 Harrison ..... B62D 49/085 180/69.1

2005/0098520 A1 5/2005 Frankenberger et al.

FOREIGN PATENT DOCUMENTS

| | | |
|---|---|---|
| DE | 29924978 U1 | 8/2007 |
| JP | H1149484 A | 2/1999 |
| WO | WO 94/21549 A1 | 9/1994 |

OTHER PUBLICATIONS

European Search Report for related European Application No. 16163096.7, dated Aug. 31, 2016 (10 pages).

* cited by examiner

*Primary Examiner* — Yuen Wong

(74) *Attorney, Agent, or Firm* — Brinks Gilson & Lione

(57) ABSTRACT

A system and method for positioning a movable crane counterweight is disclosed. In the method, a boom orientation is determined, a first counterweight position is determined, a first crane capacity at the first counterweight position is determined, a second counterweight position is determined corresponding to a second rearward stability associated with the boom orientation. A second crane capacity at the second counterweight position. A load on the crane is determined and the counterweight is positioned at a third position between the first counterweight position and the second counterweight position dependent on the boom load, and the first crane capacity.

13 Claims, 4 Drawing Sheets

SYSTEM AND METHOD FOR CRANE COUNTERWEIGHT POSITIONING

RELATED APPLICATIONS

The present patent document claims the benefit of the filing date under 35 U.S.C. §119(e) of Provisional U.S. Patent Application Ser. No. 62/141,013, filed Mar. 31, 2015, which is hereby incorporated by reference.

TECHNICAL FIELD

The disclosed subject matter relates to systems and methods for positioning a moveably counterweight on a crane.

BACKGROUND

The present application relates to lift cranes, and particularly to mobile lift cranes having a counterweight that can be moved to different positions in an effort to balance a load on the crane.

Lift cranes typically include counterweights to help balance the crane when the crane lifts a load. Since the load is often moved in and out with respect to the center of rotation of the crane, and thus generates different moments throughout a crane pick, move and set operation, it is advantageous if the counterweight, including any extra counterweight attachments, can also be moved forward and backward with respect to the center of rotation of the crane. In this way a smaller amount of counterweight can be utilized than would be necessary if the counterweight had to be kept at a fixed distance.

However, when there is no load on the hook, it is necessary to make sure that the counterweight is not in position to tip the crane backwards. Thus, if the crane needs to move without a load on the hook, the extra counterweight attachment must be close enough to the body. Additionally, safety codes may limit the distance and amount of counterweight used to prevent tipping in the case of loss of load. Thus for maximum lifting capacity, the counterweight may be extended as far as possibly while complying with general safety concerns and safety regulations which limit the extent that a counter weight may be extended from the crane.

Current systems generally position the counterweight as far away from the crane body as possible for a given boom configuration, while maintaining compliance with safety regulations or other concerns. With the counterweights in this position, the crane is at its maximum lifting capacity for the amount of counterweights present. Based on maximizing capacity alone, there is no reason why the counterweight would ever need to be positioned less than the maximum allowable extension.

BRIEF SUMMARY

In one aspect, a method for positioning a counterweight of a crane includes determining a boom orientation, determining a first counterweight position corresponding to a first rearward stability associated with the boom orientation, determining a first crane capacity at the first counterweight position, determining a second counterweight position corresponding to a second rearward stability associated with the boom orientation, determining a second crane capacity at the second counterweight position, determining a load of the crane, and positioning the counterweight at a third position between the first counterweight position and the second counterweight position dependent on the boom load, and the first crane capacity.

In some embodiments, the method further includes determining the load changing to a new load, and moving the counterweight to a fourth position between the first counterweight position and the second counterweight position dependent on the new load, and the first crane capacity. In some embodiments, the load corresponds to a set percentage of the first crane capacity and a third crane capacity associated with the third position and the new load corresponds to the same set percentage of a fourth crane capacity associated with the fourth position.

In some embodiments, the load comprises a boom strap tension. In some embodiments, the load is a boom hoist tension. In some embodiments, the load is a compression of a gantry. In some embodiments, the load is a moment between an upperworks and a lower works of a crane. In some embodiments, the load is a moment between a crane carbody and a crane crawler. In some embodiments, the load is a ground pressure associated with a crane outrigger.

In another aspect, a system for controlling the position of an counterweight on a crane includes an actuator configured to change a horizontal position of a counterweight relative to a crane body, a sensor configured to measure a crane load, and a controller in communication with the actuator, the sensor, and the input. The controller is configured to perform functions including determine a boom orientation, determine a first counterweight position corresponding to a first rearward stability associated with the determined boom orientation, determine a first crane capacity at the first counterweight position, determine a second counterweight position corresponding to a second rearward stability associated with the boom orientation, determine a second crane capacity at the second counterweight position, receive an indication of the crane load from the sensor, and cause the actuator to position the counterweight at a third position between the first counterweight position and the second counterweight position dependent on the crane load, and the first crane capacity.

In some embodiments, the functions further include determine the load changing to a new load, and cause the actuator to move the counterweight to a fourth position between the first counterweight position and the second counterweight position dependent on the new load, the first crane capacity, and the second crane capacity. In some embodiments, the functions the controller performs further comprise a function to cause the actuator to maintain a set percentage of capacity at the third counterweight position.

In some embodiments, the sensor is a boom strap tension sensor and the load is a boom strap tension. In some embodiments, the sensor is a boom hoist tension sensor and the load is a boom hoist tension. In some embodiments, the sensor is a gantry compression sensor and the load is a compression of a gantry. In some embodiments, the sensor is a moment sensor and the load is a moment between an upperworks and a lower works of a crane. In some embodiments, the sensor is a ground pressure sensor and the load is a ground pressure associated with a crane outrigger.

DETAILED DESCRIPTION

In the following passages, different embodiments are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
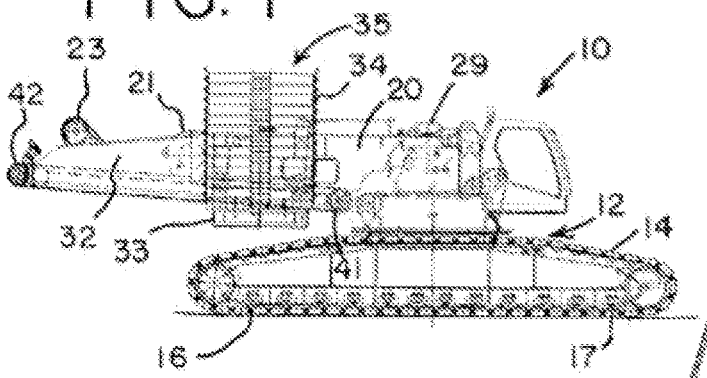
FIG. 1 illustrates a side view of an embodiment of a mobile lift crane with a counterweight assembly in a near position.
Figure 2:
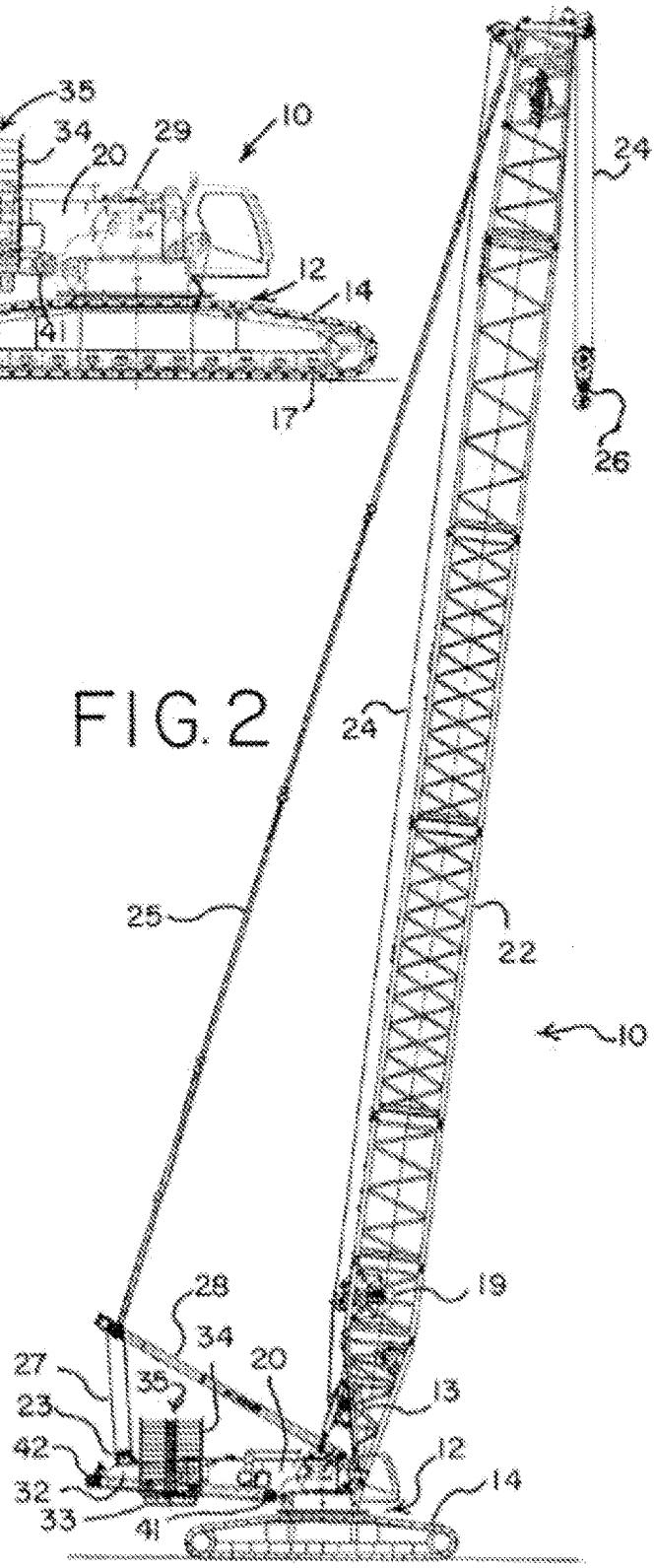
FIG. 2 illustrates a side view of the embodiment of a mobile lift crane with a counterweight assembly in an intermediate position.
Figure 3:
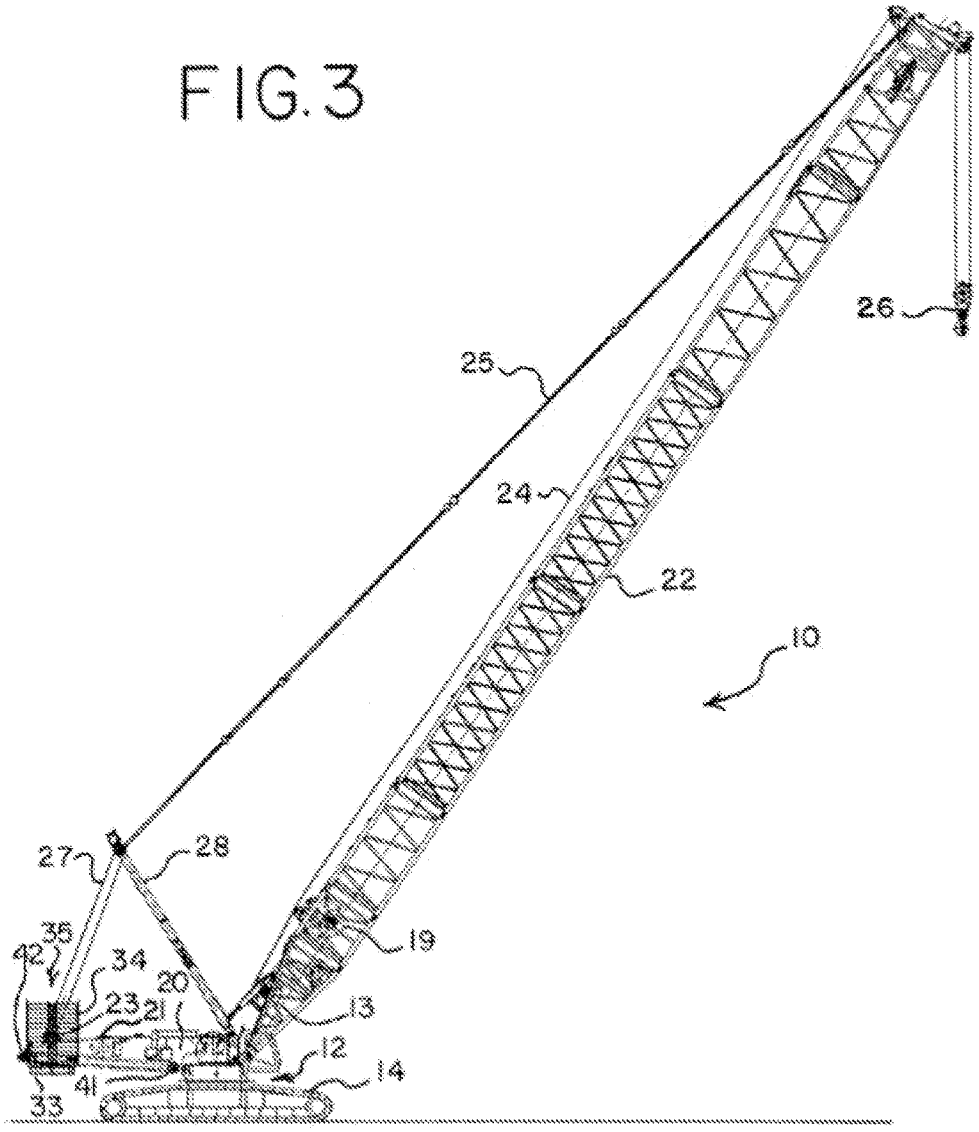
FIG. 3 illustrates a side view of an embodiment of a mobile lift crane with a counterweight assembly in a far position

FIG. 1, FIG. 2, and FIG. 3 illustrate an embodiment of a crane having a variable position counterweight. While embodiment of the system for controlling the position of the counterweight will be described primarily with response to the crane of FIG. 1, it will be understood that the described system and methods are applicable to any crane having a movable counterweight, whether the counterweights be on a track, a pivoting arm, or any other system for moving a counterweight.

The mobile lift crane 10 includes lower works, or carbody 12, ground engaging members 14 elevating the carbody 12 off the ground; and a rotating bed 20 rotatably connected to the carbody 12 about an axis of rotation. The movable ground engaging members 14 on the crane 10 are in the form of two crawlers, only one of which can be seen from the side view of FIG. 1. (FIG. 1 is simplified for sake of clarity, and does not show the boom and mast.) The movable ground engaging members 14 could be multiple sets of crawlers, such as two crawlers on each side, or other movable ground engaging members, such as tires. In mobile crane 10, the crawlers 14 provide front and rear tipping fulcrums for the crane. FIG. 1 illustrates the rear tipping fulcrum 16 and the front tipping fulcrum 17 of crane 10.

The rotating bed 20 is mounted to the carbody 12 with a slewing ring, such that the rotating bed 20 can swing about an axis with respect to the ground engaging members 14. The rotating bed 20 supports a boom 22 pivotally mounted in a fixed position on a front portion of the rotating bed 20; a live mast 28 mounted at its first end on the rotating bed 20; and a movable counterweight unit 35 having one or more counterweights or counterweight members 34 on a support member 33 in the form of a counterweight tray. The counterweights 34 in this embodiment are provided in two stacks of individual counterweight members on the support member 33. The rotating bed 20 has a fixed rearmost portion, which will be discussed in detail below. In the crane 10, since the counterweight unit 35 is movable, it does not constitute the fixed rearmost portion of the rotating bed 20, even though when the counterweight unit 35 is moved to a rearward position the outside corner of the counterweights 34 will be the furthest from the rotational axis or centerline and thus define the tail swing of the crane 10. However, when the counterweight unit 35 is pulled forward, as in FIG. 1, the fixed rearmost portion of the rotating bed 20 will define the tail swing of the crane 10.

A boom hoist system on crane 10 allows the angle of the boom 22 relative to a plane of rotation of the rotating bed 20 to be changed. The plane of rotation is typically perpendicular or nearly so to the axis of rotation. In the crane 10, the boom hoist system includes rigging connected between the rotating bed 20, the mast 28, and the boom 22. The boom hoist system includes a boom hoist drum 21 and boom hoist line 27 reeved between a sheave or sheave set on a second end of the mast 28 and a sheave or sheave set 23 on the rotating bed 20. The mast 28 is pivotally connected to the rotating bed 20, and the boom hoist rigging between the mast 28 and the boom 22 comprises only fixed length members or pendants 25 (only one of which can be seen in the side view) connected between the mast 28 and a top of the boom 22. In addition the boom hoist rigging includes multiple parts of boom hoist line 27 between sheaves 23 on the rotating bed 20 and sheaves on the second end of the mast 28. A boom hoist drum 21 on the rotating bed 20 can thus be used to take up or pay out boom hoist line 27, changing an angle of the live mast 28 with respect to the rotating bed 20, which in turn then changes an angle of the boom 22 with respect to the rotating bed 20. Alternatively, the mast 28 could be used as a fixed mast during normal crane operation, with boom hoist line 27 running between an equalizer and the top of the mast 28 to change an angle between the mast 28 and the boom 22.

A load hoist line 24 for handling a load extends from the boom 22, supporting a hook 26. The rotating bed 20 may also include other elements commonly found on a mobile lift crane, such as an operator's cab and whip line drum 29. The load hoist drum 13 for the hoist line 24 is preferably mounted on a boom butt of the boom 22, as shown in FIG. 2. If desired, an additional hoist drum 19 can be mounted at a base of boom 22, as shown in FIGS. 2 and 3. The boom 22 may comprise a luffing jib pivotally mounted to the top of the main boom 22, or other boom configurations.

The counterweight unit 35 is movable with respect to the rest of the rotating bed 20. In the crane 10, the rotating bed 20 includes a counterweight support frame 32, preferably in the form of a welded plate. The counterweight support frame 32 supports the movable counterweight unit 35 in a movable relationship with respect to the counterweight support frame 32. The counterweight support frame 32 comprises a sloped surface provided by flanges welded to the plate structure of the counterweight support frame 32. The counterweight unit 35 moves on the surface if the flanges, the surface sloping upwardly compared to the plane of rotation between the rotating bed 20 and the carbody 12 as the counterweight support frame 32 extends rearwardly. The counterweight tray 33 includes rollers, which rest on the flanges. The rollers are placed on the top of the counterweight tray 33 so that the counterweight tray 33 is suspended beneath the counterweight support frame 32. In the crane 10, the counterweight support frame 32 constitutes the fixed rearmost portion of the rotating bed 20. Further, the counterweight support frame 32 is supported on the rotating bed 20 in a fashion such that the moment generated by the counterweight unit 35 acts on the rotating bed 20 predominantly, and in this case only, through the counterweight support frame 32.

A counterweight movement system is connected between the rotating bed 20 and the counterweight unit 35 so as to be able to move the counterweight unit 35 toward and away from the boom 22. The counterweight unit 35 is movable between a position where the counterweight unit 35 is in front of the fixed rearmost portion of the rotating bed 20, such that the tail swing of the crane 10 is dictated by the fixed rearmost portion of the rotating bed 20 (as seen in FIGS. 1 and 2), and a position where the counterweight unit 35 dictates the tail swing of the crane 10. Preferably the counterweight unit 35 can be moved to a point so that the center of gravity of the counterweight unit 35 is near to, and preferably even in front of, the rear tipping fulcrum 16 the crane 10, as seen in FIG. 1.

The counterweight movement system in the crane 10 comprises a counterweight unit movement device made up of a drive motor and a drum 42 on a rear of the counterweight support frame 32. Preferably the counterweight unit movement device has two spaced apart identical assemblies, and thus the drive motor drives two drums 42. Each assembly of the counterweight unit movement device further includes a flexible tension member that passes around a driven pulley and idler pulley (best seen in FIG. 1). The driven pulleys are provided by drums 42. The flexible tension member may be a wire rope as shown, or a chain. Of course if a chain is used, the driven pulley will be a chain drive. Both ends of each flexible tension member are connect to the counterweight tray 33, so that the counterweight unit 35 can be pulled both toward and away from the boom 22. Preferably this is accomplished by having an eye on both ends of the flexible tension member or wire rope and holes in a connector on the counterweight tray 33, with pins through the eyes and the connector. Thus, in the crane 10, the counterweight unit movement device is connected between the counterweight support frame 32 and the counterweight unit 35.

While FIG. 1 shows the counterweight unit 35 in its most forward position, FIG. 2 shows the counterweight unit 35 in a mid-position, and FIG. 3 shows the counterweight unit 35 in its most rearward position, such as when a large load is suspended from the hook 26, or the boom 22 is pivoted forward to extend a load further from the rotating bed 20. In each of these positions, the crane 10 is configured such that during crane operation, when the counterweight unit 35 is moved to compensate for changes in the combined boom and load moment, the weight of the counterweight unit 35 is transferred to the rotating bed 20 through the counterweight support frame 32.

The positioning of the counterweight unit 35 is controlled by a crane controller coupled with at least one sensor for determining an operating condition of the crane. The crane controller controlling the counterweight movement system, and possibly other operations of the crane, receives signals from the sensor indicating the condition (such as the boom angle), or some other function indicative of the condition (such as tension in the boom hoist rigging, which is indicative of the combined boom and load moment, or the moment of the boom 22 and load about the hinge pins of the boom 22) and controls the position of the counterweight unit 35. The position of the counterweight unit 35 may be detected by keeping track of the revolutions of drums 42, or using a cable and reel arrangement (not shown). The crane 10 using such a system will preferably comprise a computer readable storage medium comprising programming code embodied therein operable to be executed by the computer processor to control the position of the counterweight unit 35.

Figure 4:
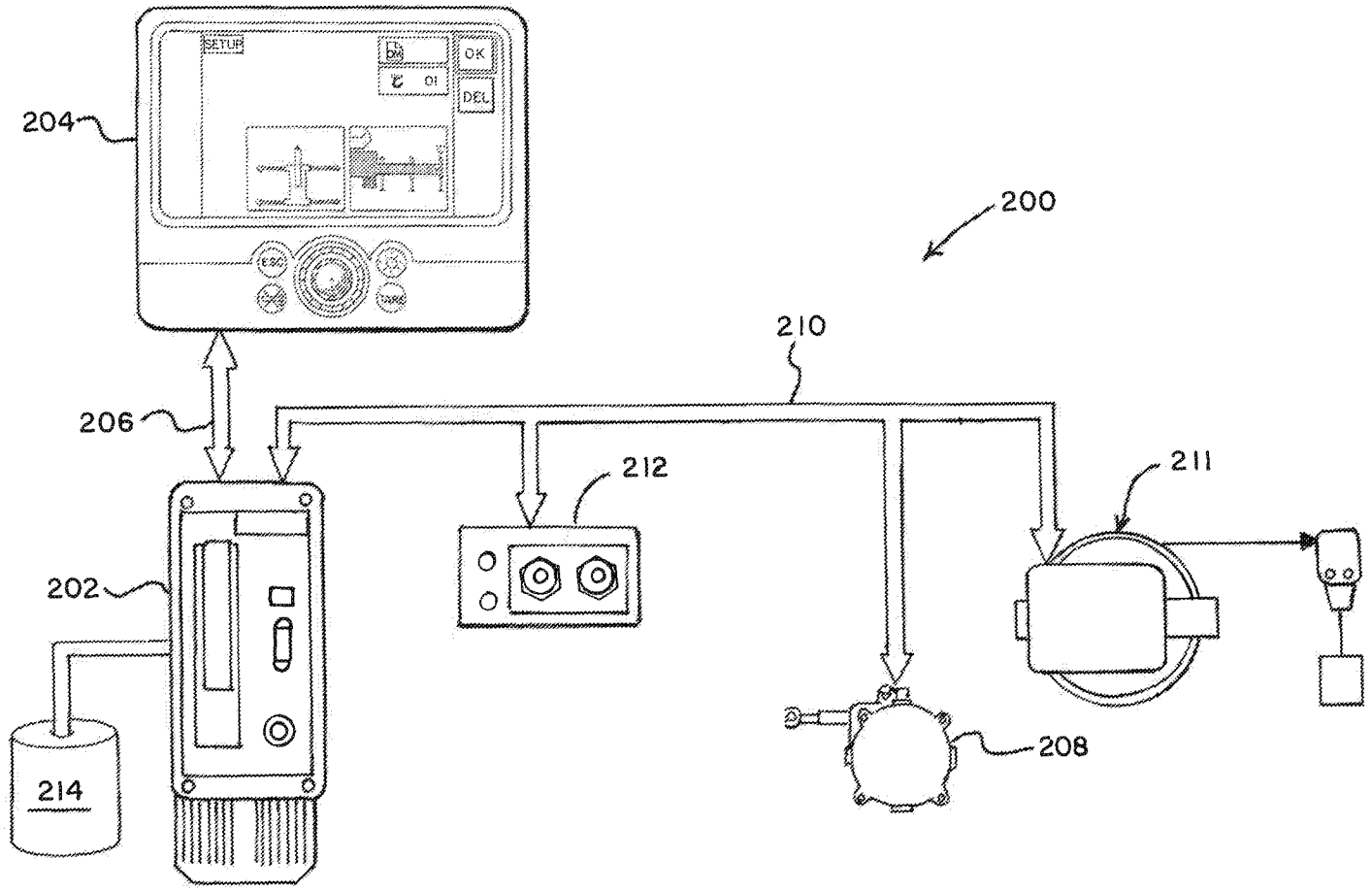
FIG. 4 illustrates a control system for controlling the position of a counterweight.

FIG. 4 illustrates a schematic of an exemplary embodiment of a crane control system 200. The crane control system 200 includes a processing unit 202 and a graphics display 204 operably coupled to the processing unit 202. In the embodiment of FIG. 4, the processing unit 202 and the graphics display 204 are shown as separate physical units, but in some embodiments they are a single physical unit. The processing unit 202 is operably coupled to the graphics display 204 through a graphics interface 206, such as a Video Graphics Array (VGA) connector, a serial connection, a Digital Video Interface (DVI), a wireless data connection, or any other connector capable of transferring display information from the processing unit 202 to the graphics display 204. The display information may be transferred directly, or in some embodiments may have at least one other device between the processing unit 202 and the graphics display 204. The graphic display of FIG. 4 is a liquid crystal display (LCD) but other display types are possible, such as organic light-emitting diodes (OLED), projection, cathode ray tube (CRT), heads up display (HUD), plasma, electronic ink, and other displays.

The exemplary embodiment 200 further includes sensors such as a length sensor 208 operably coupled to the processing unit 202. The length sensor may measure the status of crane components such as a boom length, an outrigger length, or the position of an adjustable counterweight. In the embodiment of FIG. 4, the length sensor 208 is operably coupled to the processing unit 202 through a bus 210. Generally there are other sensors such as angle sensors which are operably coupled to the processing unit. Any type of sensor capable of measuring a condition of the crane may be used as long as it transmits a signal representative of the condition to the processing unit 202. The sensor 208 can be an analog sensor and transmit an analog signal, the analog signal can be converted to a digital signal prior to transmission, the signal can be a digital signal, or the signal could be a digital signal converted to an analog signal prior to transmission. Other sensors 212 are operably coupled to the processing unit 202 and serve other functions such as monitoring the boom. The other sensors 212 provide the processing unit 202 with other signals representative of other information such as a boom length or counterweight configuration. At least one sensor 211 is operably coupled to the processing unit and measures a load on the boom such a hoist line load, load moment on the boom, or a stress in a crane component such as live mast 28.

The processing unit 202 can be operably coupled directly to the sensor 208 as shown in FIG. 4, or in some embodiments, various components may be between the processing unit 202 and the sensor 208. The sensor 208 and the processing unit 202 are considered to be operably coupled so long as the sensor 208 is able to provide the processing unit 202 with the signal representative of the condition it is measuring.

A data storage unit 214 is operably coupled to the processing unit 202 and stores computer executable instructions for execution by the processing unit 202. The computer instructions cause the processing unit 202 to perform a series of functions that will be described in more detail later. Briefly, the computer executable instruction cause the processing unit 202 to determine a first load chart for the determined boom configuration with the counterweight positioned at a first extension, a second load chart for the determined boom configuration with the counterweight positioned at a second extension, and cause the counterweight to be positioned between the first and second extension, among other typical crane functions.

In some embodiments, the processing unit 202 calculates a load chart based on the determined crane configuration. In other embodiments, a plurality of mobile crane load charts are stored in the data store 214 and the processing unit 202 selects an appropriate load chart based on the determined configuration. For example, if the data store 214 has three load charts based on a particular counterweight position, the processing unit 202 would select a load chart that is valid for determined configuration.

Figure 5:
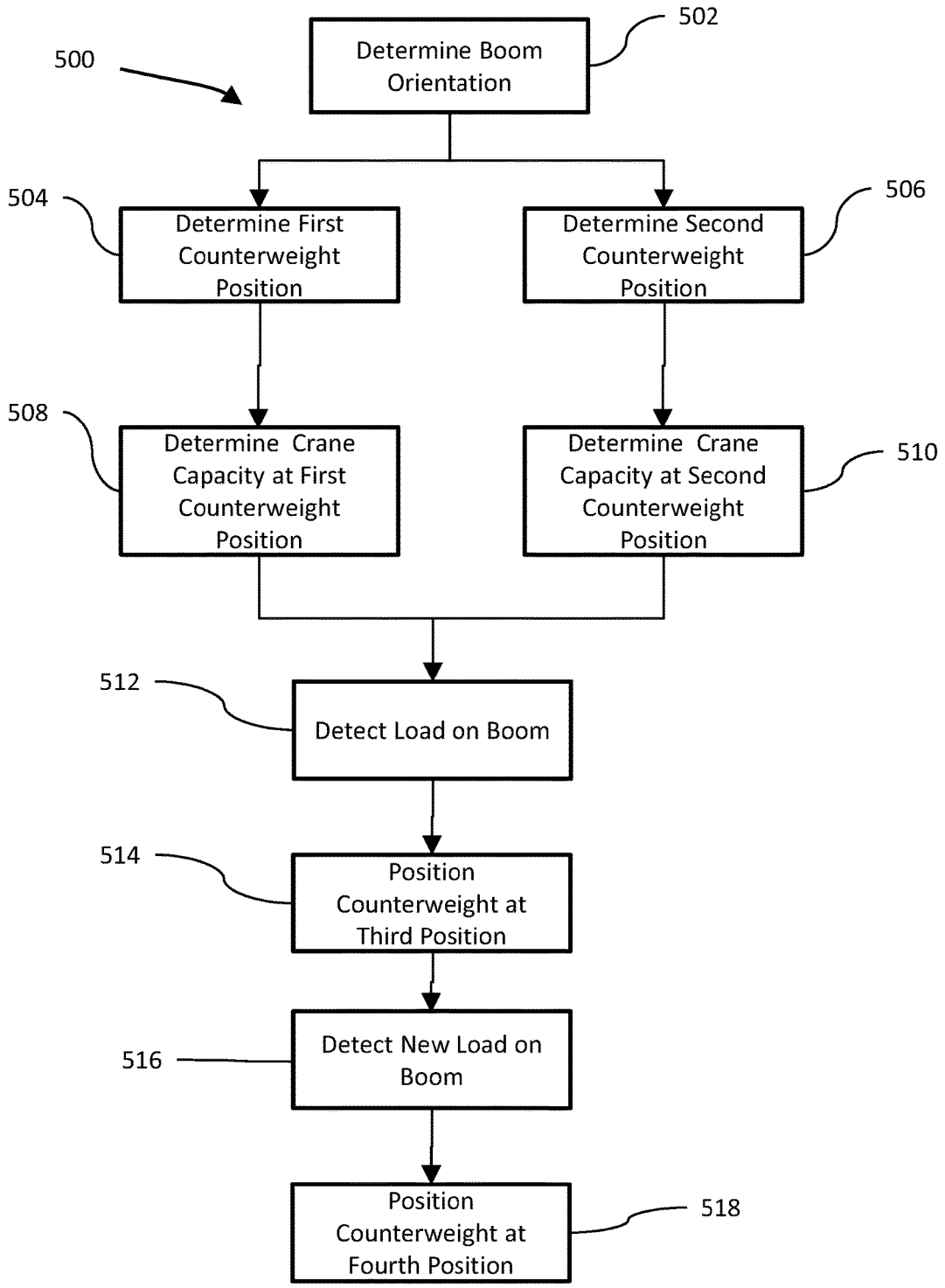
FIG. 5 illustrates a flowchart of a method for controlling the position of a counterweight.

FIG. 5 illustrates a flow chart of a method 500 for controlling the position of a counterweight assembly. Computer executable instructions configured to cause the crane controller to perform the method may be stored in data store. Previous methods of moving the counterweight resulted in maximizing the capacity of the crane, but come with some drawbacks. Because the crane is heavily weighted towards the rear, the ground pressure is not even, with the rear of the crane having a higher ground pressure. This may have a negative impact on stability. Furthermore, with the crane heavily weighted towards the rear, the crane may suffer increased wear at the rear of the crane do the higher pressure. The presently described method of controlling the position of a crane overcomes these negative aspects, while still allowing for increased capacity relative to a standard crane.

The method 500 begins in with the determination of the boom orientation in block 502. The boom orientation may be determined automatically using at least one sensor in communication with the control system. For example, the position of the boom may be determined through angle sensors and a length sensor. Or in other embodiments, the boom orientation may be input manually. For instance, a user may use the user interface to input at least one characteristic such as the length of the boom or the presence of a luffing jib. Or, in still other embodiments, a combination may be used such as a user entering the boom characteristics and at least one sensor detecting a changing characteristic, such as a boom angle.

In block 504, a first counterweight position is determined corresponding to a first rearward stability associated with the detected boom orientation. For example, the first counterweight position may be a position associated with a forty percent rearward stability. The first counterweight position may be determined through a calculation by the control system, or by finding a load chart having the first rearward stability with no load on the boom. In block 506, a second counterweight position is determined corresponding to a second rearward stability associated with a boom orientation. This rearward stability amount may correspond to a maximum counterweight extension with no load on the boom. For example, if regulations require a rearward stability of seventy percent or less, the second counterweight position may correspond to a rearward stability of seventy percent.

In block 508, a first crane capacity is determined based on the counterweight being at the first counterweight position. For example, the crane controller may calculate the capacity at the first counterweight position, or look up the maximum capacity based on a load chart. In block 510, a second crane capacity is determined based on the counterweight being at the second counterweight position.

In block 512 a load on the crane is determined by the control system. For example, the tension in a hoist line may be measured, a load on a backstay may be measured, or moment of the boom may be measured. In block 514, the counterweight is positioned at a third position between the first counterweight position and the second counterweight position. The position is dependent on the boom load and the first crane capacity. In some embodiments, the position may further be dependent on the second crane capacity. For example, the third counterweight position may be a function of the percentage of the measured load relative to the maximum load at the first position. As the measured load approaches a set amount of the maximum load at the first position, the third position moves a proportional amount. Or in other embodiments, the position may be further dependent on the second crane capacity, such that as the measured load approaches the second crane capacity, the counterweight moves a proportional amount.

In block 516, the control system detects a change of the load to a new load and in response, in block 518 the counterweight is moved to a fourth position between the first counterweight position and the second counterweight position dependent on the new load and the first crane capacity, and possibly the second crane capacity. The load may correspond to a set percentage of the first crane capacity and the new load may be the set percentage of a third capacity associated with the third percentage of the first capacity. For example, the counterweight may move such that the crane operates at fifty percent capacity, with capacities less than fifty percent resulting in the first counterweight position and capacities greater than fifty percent resulting in the second counterweight position.

The load detected by the control system may be a boom strap tension, a boom hoist tension, a compression of a gantry supporting the counterweight, a load moment between an upper works and a lower works of a crane, a load moment between a crane carbody and a crane crawler, and a ground pressure associated with a crane outrigger. Each of these techniques for measuring a load as well as others are well known in the art.

Embodiments are further directed to a system for controlling the position of a counterweight on a crane. The system includes an actuator, such as a hydraulic cylinder or rack and pinion. The actuator is configured to change a horizontal position of a counterweight relative to a crane body. At least one sensor is configured to measure a crane load. The crane load may be one of, or a combination of, boom strap tension, a boom hoist tension, a compression of a gantry, a load moment between an upperworks and a lower works of a crane, a load moment between a crane carbody and a crane crawler, and a ground pressure associated with a crane outrigger. The system further includes a controller, such as the controller of FIG. 4. The controller is in communication with the actuator, the sensor, and the input. The controller implements functions including those previously described in the method of FIG. 5.

It should be understood that various changes and modifications to the presently preferred embodiments described herein will be apparent to those skilled in the art. For example, the crane controller could be separate from other control systems of the crane, or it may be integrated with further functionality. Additionally, while not described in detail, one of ordinary skill in the art will recognize that the different embodiments may be used in combination with one another.

The invention claimed is:

1. A method for positioning a counterweight of a crane, comprising:

determining a boom orientation;

determining a first counterweight position corresponding to a first rearward stability associated with the boom orientation;

determining a first crane capacity at the first counterweight position;

determining a second counterweight position corresponding to a second rearward stability associated with the boom orientation;

determining a second crane capacity at the second counterweight position;

establishing a target capacity percentage;

determining a load of the crane;

positioning, with a crane counterweight movement system, the counterweight at a third position between the first counterweight position and the second counterweight position such that the crane load is the target capacity percentage of a third capacity at the third position;

determining the crane load changing to a new load; and positioning, with the crane counterweight movement system, the counterweight to a fourth position between the first counterweight position and the second counterweight position such that the new load is the target capacity percentage of a fourth capacity at the fourth position.

2. The method of claim 1, wherein the load comprises a boom strap tension.

3. The method of claim 1, wherein the load is a boom hoist tension.

4. The method of claim 1, wherein the load is a compression of a gantry.

5. The method of claim 1, wherein the load is a moment between an upperworks and a lower works of the crane.

6. The method of claim 1, wherein the load is a moment between a crane carbody and a crane crawler.

7. The method of claim 1, wherein the load is a ground pressure associated with a crane outrigger.

8. A system for controlling the position of a counterweight on a crane, comprising:

an actuator configured to change a horizontal position of a counterweight relative to a crane body;

a sensor configured to measure a crane load; and a controller in communication with the actuator, the sensor, and the input, the controller configured to perform functions comprising:

determining a boom orientation;

determining a first counterweight position corresponding to a first rearward stability associated with the determined boom orientation;

determining a first crane capacity at the first counterweight position;

determining a second counterweight position corresponding to a second rearward stability associated with the boom orientation;

determining a second crane capacity at the second counterweight position;

establishing a target capacity percentage;

receiving an indication of a crane load from the sensor;

causing the actuator to position the counterweight at a third position between the first counterweight position and the second counterweight position such that the crane load is at the target capacity percentage of a third capacity at the third position;

receiving an indication of a new crane load from the sensor; and causing the actuator to position the counterweight at a fourth position between the first counterweight position and the second counterweight position such that the crane load is at the target capacity percentage of a fourth capacity at the fourth position.

9. The system of claim 8, wherein the sensor is a boom strap tension sensor and the load is a boom strap tension.

10. The system of claim 8, wherein the sensor is a boom hoist tension sensor and the load is a boom hoist tension.

11. The system of claim 8, wherein the sensor is a gantry compression sensor and the load is a compression of a gantry.

12. The system of claim 8, wherein the sensor is a moment sensor and the load is a moment between an upperworks and a lower works of the crane.

13. The system of claim 8, wherein the sensor is a ground pressure sensor and the load is a ground pressure associated with a crane outrigger.

* * * * *